United States Patent [19]

Longinotti

[11] 4,306,595

[45] Dec. 22, 1981

[54] EQUIPMENT TO LOAD AN UNDERLAYER IN A MOULD FOR MAKING CEMENT TILE AND FOR SIMILAR USES

[75] Inventor: Alfredo Longinotti, Florence, Italy

[73] Assignee: Centro di Ricerca Enrico Longinotti Firenze S.p.A., Italy

[21] Appl. No.: 103,494

[22] Filed: Dec. 14, 1979

[30] Foreign Application Priority Data

Dec. 21, 1978 [IT] Italy ..... 9674 A/78

[51] Int. Cl.[3] ..... B65B 1/16; B65B 43/50

[52] U.S. Cl. ..... 141/284; 141/177; 141/181; 425/257; 425/258

[58] Field of Search ..... 141/1, 9, 12, 100, 129, 141/177, 181, 182, 270, 283, 284, 367, 392; 222/344; 264/333; 425/257, 258

[56] References Cited

U.S. PATENT DOCUMENTS 3,656,517 4/1972 Taylor et al. ..... 141/1

*Primary Examiner*—Frederick R. Schmidt

*Attorney, Agent, or Firm*—McGlew and Tuttle

[57] ABSTRACT

A device for loading a dosage layer of material, preferably concrete, at a laying-down position for manufacturing tiles and the like comprising, a conveyor for supplying a continuous layer of the material, a bell having a diaphragm and edges surrounding the diaphragm defining a dosage space for receiving a dosage layer of the material and a driving unit for driving the bell to move it into engagement with the continuous layer on the conveyor to receive a dosage layer of material in the dosage space. A suction pump is connected to the interior of the bell for establishing an underpressure therein so that the dosage layer of material is held by suction in the dosage space. A plurality of the bells may be provided on a single turret so that one dosage layer of material is being drawn up while another dosage layer of material is being laid down at another location.

7 Claims, 9 Drawing Figures

EQUIPMENT TO LOAD AN UNDERLAYER IN A MOULD FOR MAKING CEMENT TILE AND FOR SIMILAR USES

BACKGROUND OF THE INVENTION

The present invention relates, in general to an equipment for loading an underlayer or second layer of cement material in moulds for making cement tiles, or the like, and in particular to new and useful apparatus which includes suction bell means having a porous diaphragm encircled by an edge, which is adapted to penetrate into a layer of material to be drawn into the bell means.

SUMMARY OF THE INVENTION

It is an object of the invention to reduce the time needed to carry out an operational cycle, in order to increase productivity. Another object is that of limiting the accelerations and decelerations of the equipment. Other objects and advantages will be evident to those skilled in the art.

According to the invention a number of bells are provided and carried by angularly and intermittently displaced means for subsequently moving each bell into at least a drawing up position and a laying down position of the material layer. Means are also provided to synchronically obtain the angular displacement and the vertical displacements of the bell equipment, and to establish in each bell, an atmospheric pressure or an underpressure.

In practice the equipment rotates intermittently around a column, along which it also slides axially. Pins for centering and checking the angular positions of the equipment are provided. A rotary shutter determines and establishes the atmospheric or under pressure in each bell.

A control system may be combined in the form of an arm, movable around the column and bearing a coupling pin engaging the shutter in any axial position of the equipment and also engaging the equipment in its raised position, to enable angular displacements of the shutter only, or of the shutter and the equipment, in an integral way. The equipment with three bells is displaceable into at least three angular positions around the column. Each of the bells cyclically reaches a drawing up position, a laying down position of the layer of carried material and at least one waiting position and, if required, a cleaning position.

Annular edges around the bells are adjustable with respect to the bell and the diaphragm to adjust the thickness of the layer to be drawn up by each bell.

Accordingly, another object of the present invention is to provide a device for loading a dosage layer of material at a laying-down position to form a tile comprising, material layer supply means adapted for providing a layer of material in a drawing-up position, bell means having an air-permeable diaphragm and surrounding edge defining a dosage space for receiving the dosage layer of material, drive means connected to the bell means for intermittently moving the bell means into the drawing-up position to receive a dosage layer of material in the dosage space and then into the laying-down position to release the dosage layer of material, and suction means connected to the bell means for establishing an underpressure therein when the bell means is in the drawing-up position for holding the dosage layer in the dosage space and for establishing atmospheric pressure in the bell means when the bell means is at the laying-down position to release the dosage layer of material.

A further object of the invention is to provide a device for loading a dosage layer of material which is simple in design, rugged in construction and economical to manufacture.

For an understanding of the principles of the invention, reference is made to the following description of a typical embodiment thereof as illustrated in the accompanying drawings.

DESCRIPTION OF THE PREFERRED EMBODIMENT

Figure 1:
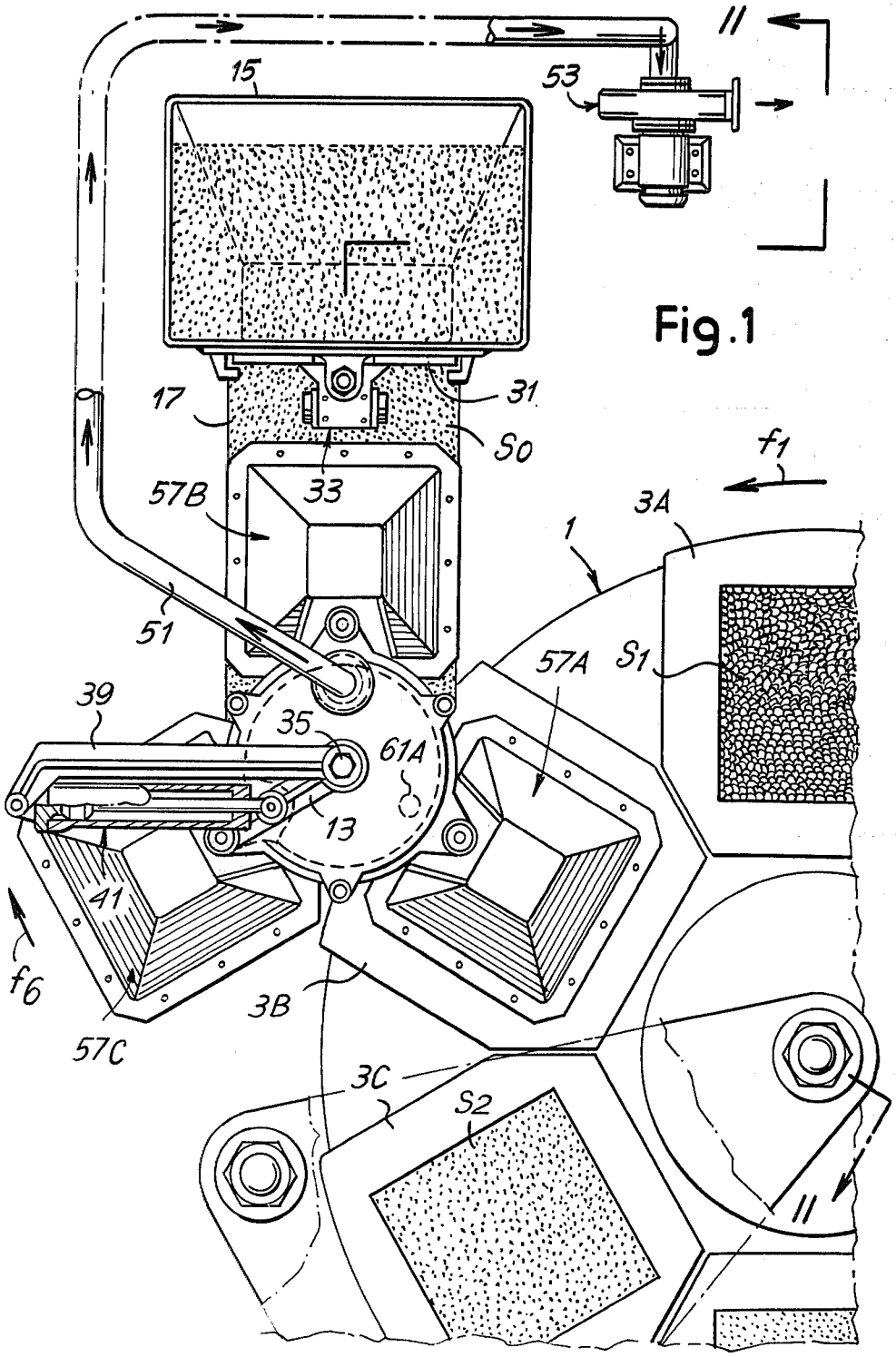
FIGS. 1 and 2 are partial plan and vertical section views respectively, with FIG. 2 taken alone broken line II—II of FIG. 1, of a moulding equipment with a metering device according to the invention, in a first array, that is in a first phase or position operation.
Figure 2:
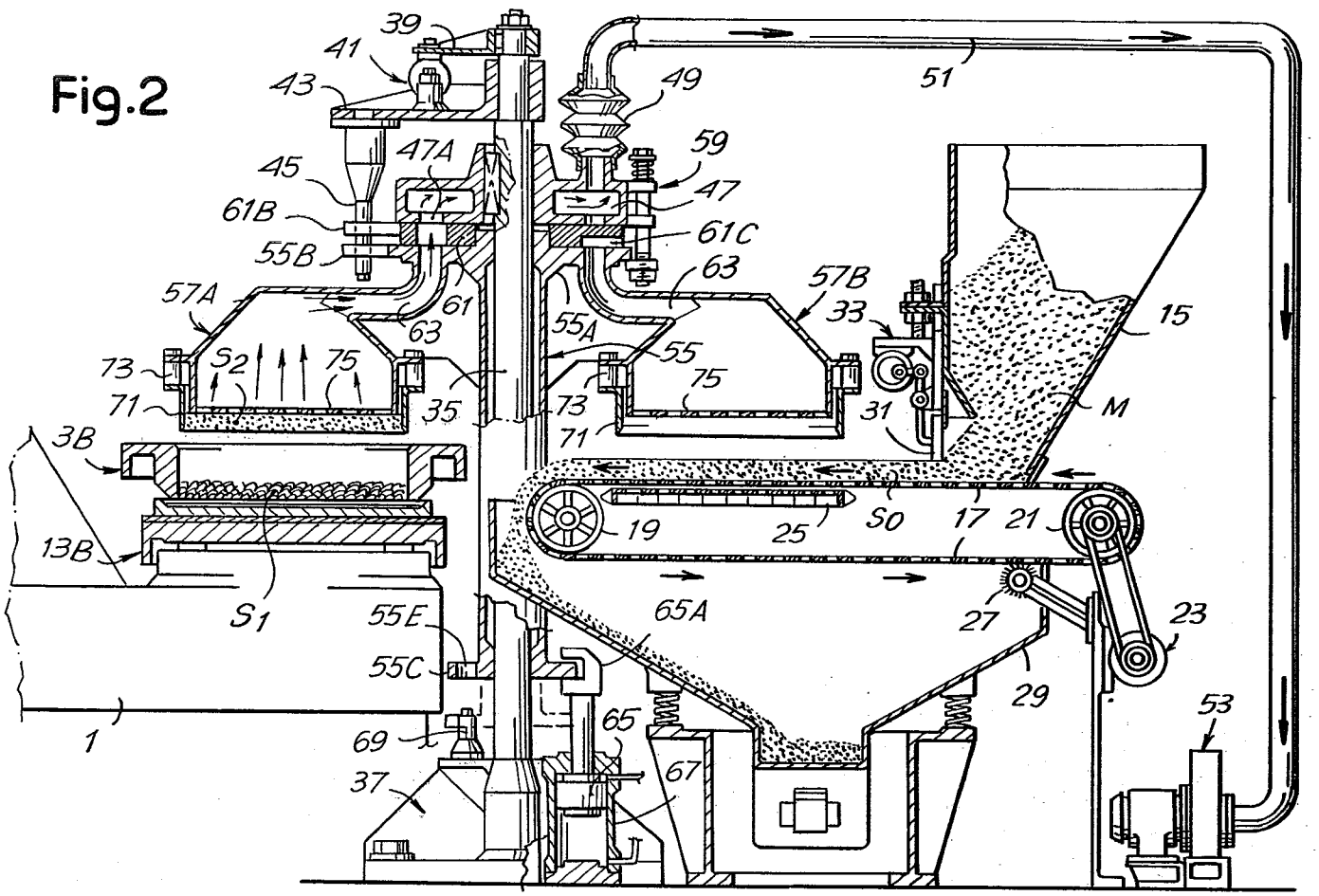

In the annexed drawing, and FIG. 1 particularly 1 denotes a rotating table typical of a rotary press having several moulds 3A, 3B, 3C thereon which denote the mold frames in their positions. The position of the frame 3B is that of loading of the so-called second layer or underlayer of the cement tile to be formed. 13B denotes the bottom of the frame in position 3B (FIG. 2). The table 1 rotates stepwise in the direction of arrow f1, to move each mould into the various positions. Mould in the position 3A has received the material of the surface layer S1 and then is moved to the position 3B–13B to receive the material of the second layer or underlayer denoted by S2, in order to be moved afterwards to the position 3C and the subsequent ones for the pressing and the drawing steps.

The apparatus to be described effects the automatic loading of the material of the second layer S2 and the dosage of the same, within a relatively short time and, in any case, a time which will not delay the production rhythm of the tile plant, and with the maximum uniformity of distribution of the material and compactedness of the same.

A tank is provided for the feeding of the second layer material, with an arrangement oriented according to a certain inclination with respect to the radial direction defining the position 3B of the mould which must receive the underlayer or second layer S2. This tank has a hopper 15 overlaying a continuous flexible belt conveyor 17, which is moved by rollers 19, 21. This conveyor is operated to be intermittently rotated by a power unit 23 which can operate the plant with intermittent movement. The flexible belt conveyor 17 is porous, that is air-permeable, and its upper horizontal run may slide upon a support 25, which is also porous, that is air-permeable. On the lower arm or run of the belt 17, a cleaning brush 27 may operate. Below the conveyor belt 17 a conduit or a collection hopper 29 is provided for the excess material which must be carried away or lead back to the hopper 15. At least the conduit or the hopper 29 may be vibrated. From the hopper 15 the material M which is to form the underlayer is fed in the form of a layer SO on the conveyor belt 17 and the thickness of this layer SO may be adjusted by displacing a scraper or blade 31 with an adjustment device 33, which allows a vertical displacement of this scraper and, advantageously, also its vibration, to make the formation of the layer SO even.

In a substantially radial alignment with the mould in position 3B and outside the table 1, a column 35 is placed and borne from a base 37, whose upper part may also be supported (FIG. 2). An arm 39 is integrally connected to an upper part of colum 35. One of the two elements of a cylinder-piston system 41 is fixed, to arm 39 and the other element is pivotally connected to an arm 43 idly borne by the column 35. With the arm 43, a coupling pin 45 is integrally connected which is vertical and therefore parallel to the column 35. This coupling pin 45 is angularly but not axially movable with respect to the column 35. Pin 45 with actuator 41 and arm 39 form rotary drive means.

A collector 47 is engaged on the column, which is axially displaceable, but angularly stable. The collector 47 is connected through a bellows 49 with a conduit 51 leading to the suction side of a suction pump 53.

Figure 9:
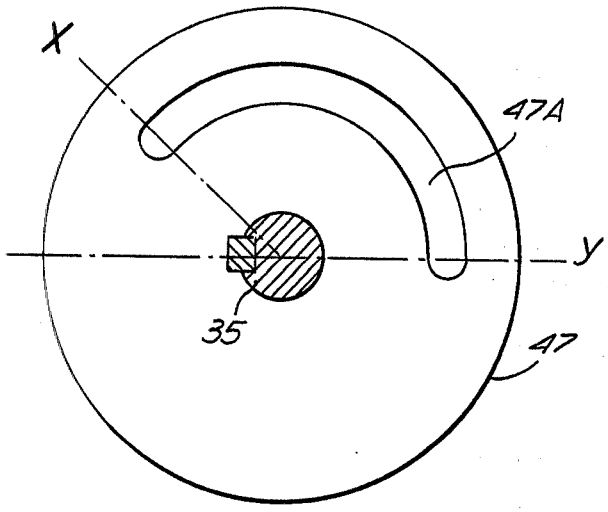
FIGS. 7, 8 and 9 show details of FIG. 2, with FIGS. 8 and 9 taken from the lines VIII—VIII and IX—IX of FIG. 7 respectively.
Figure 7:
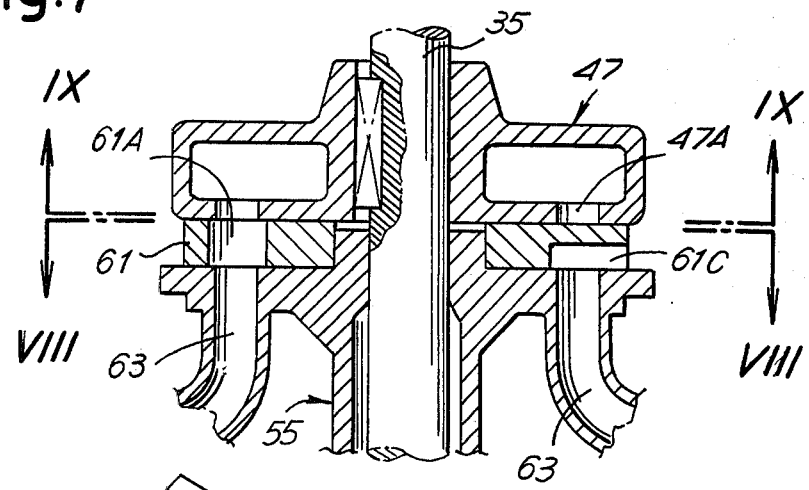
Figure 8:
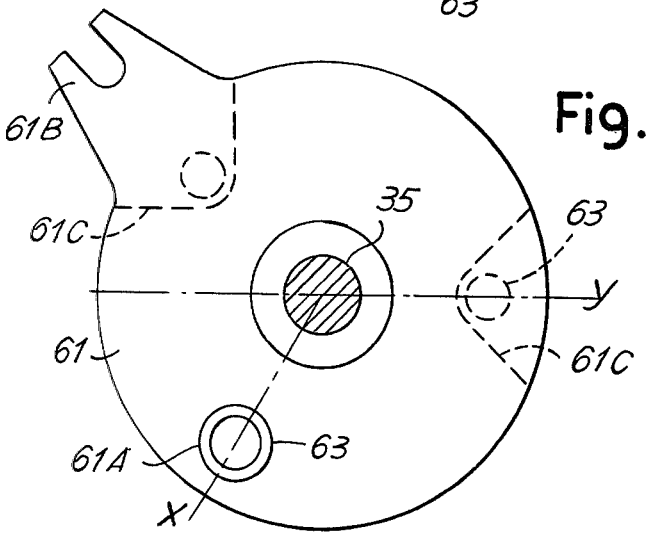

An element 55 is mounted on the column 35, to slide and to rotate, which forms a turret provided with three bells or bell means 57 angularly equidistant from one another with respect to the axis of the column 35. Each bell can subsequently reach three positions, which are shown at 57A, 57B and 57C. The bell in position 57A (laying-down position) is set above the frame 3 of the mould in position 3B; the bell in position 57B is set above the active arm of the conveyor belt 17 and in correspondence of the support 25 and the bell in position 57C is in a waiting position. The equipment or turret 55, bearing the bells 57, is axially connected to the collector 47 with suitable resilient connection means 59 or the like, so that between the collector 47 and an upper plate 55A of the equipment 55 at a sealing pressure, a movable shutter 61 is interposed. From the plate 55A connections 63 extend between the interior of bells 57 and the surface of the plate 55A connected to the shutter 61. This shutter 61 has a bore 61A, which may be displaced by 120°, as it can be appreciated comparing FIGS. 1, 4 and 7 and as it appears from FIGS. 7 and 8. Considering these figures it is clear that the shutter 61 and therefore the bore 61A may be displaced between two radial fixed alignments shown with X and Y; the alignment X corresponding to that between the column 35 and the angular displacement axis of platform 1, while the alignment Y corresponds to that of the symmetry vertical plane of the assembly 15, 17. The shutter 61 has a radial fork appendix 61B, within which the connecting pin 45 is engaged, and with respect to which pin the fork appendix 61B can move in parallel to the axis of the pin 45. Also the plate 55A of the equipment 55 has a fork or bore-like appendix 55B, which may engage the pin 45 in a lowered position of the equipment 55. The collector 47 has an opening 47A (see in particular FIGS. 7 and 9) which extends at least between the above mentioned angular positions X and Y. The shutter 61 has two recesses 61C on the lower connection surface with plate 55A. These recesses 61C are moved so as to enable the presence of one of them alternatively in the positions 57A and 57B, with the displacement of member 61 for an angular magnitude substantially corresponding to the angle between the two radial alignments X and Y.

The cylinder-piston system 41 can move the pin 45 by an angular length with respect to the column 35 equal to the angle between the two alignments X and Y.

The equipment 55 has in its lower part a flange 55C, which is engaged in an angularly movable manner by a moulded end 65A of the stem of a piston 65 of a cylinder-piston system or vertical drive means, whose cylinder 67 is integral with the base 37. The system 65, 67 serves to raise and lower the equipment 55 and therefore the bells 57, while allowing their rotation. The flange 55C has a bore 55E capable to cooperate with a fixed centering pin 69, when the equipment 55 is lowered.

Each of the bells 57 has a perimetrical edge 71, which is carried by the structure of the respective bell through replaceable thicknesses or spacers 73 for the arrangement of the position of the edge 71 and therefore for the dosage or thickness of the underlayer S2. The adjustment of each of the edges 71 is effected with respect to a porous diaphragm, that is to a porous wall 75 in the lower part of each bell 57. The edge 71 is projected more or less downwards with respect to the wall 75 with its own beveled edge adapted to penetrate into the material of the layer SO until it is in contact with the belt conveyor 17, while the porous wall 75 must touch the layer SO. This is obtained through suitable relative adjustments between the press and the loader assembly and/or between the press and the equipment 55–57 and/or between the latter and the assembly of the conveyor 17.

The operation of the assembly is as follows.

In a first initial phase of operation, the various elements are in the position shown in FIGS. 1 and 2. In this position, the bell in position 57B is opened towards the atmosphere due to the presence of the recess 61C in correspondence of the connection 63 of the bell 57B. The bell in position 57A is exposed to underpressure through its own connection, the bore 61A and the collector 47A, 47. The bells with the equipment 55 are raised above the layer SO and the layer S1 and the frame 3B. The bell in position 57A holds the quantity of underlayer S2 between the edge 71 and the wall 75, the holding of the material being due to the depression of pressure in the bell and therefore to the suction of air through the material of the layer S2. The equipment 55 being raised, the pin 45 engages both appendixes 61B, 55B. In this array, the table 1 has been moved and a mould has arrived in the position 3B which is to receive an underlayer S2.

In the subsequent phase (FIG. 3) the cylinder-piston system 65, 67 lowers the equipment 55 centering it with the pin 69, so as to ensure the exact penetration of the edge 71 of the bell into position 57A inside the frame in position 3B. The bell 57A is lowered then in the frame while still holding the layer S2, and the bell in position 57B penetrates with its own edge 71 in the layer SO, the bell 57B still standing at atmospheric pressure. The penetration of the edge 71 into the layer SO must be such as to contact the conveyor 17, and adjustment of the edge 71 itself is obtained through the selection of the thicknesses 73. The pin 45 maintains the appendix 61B of the shutter engaged, but loses its hold on the appendix 55B.

Figure 3:
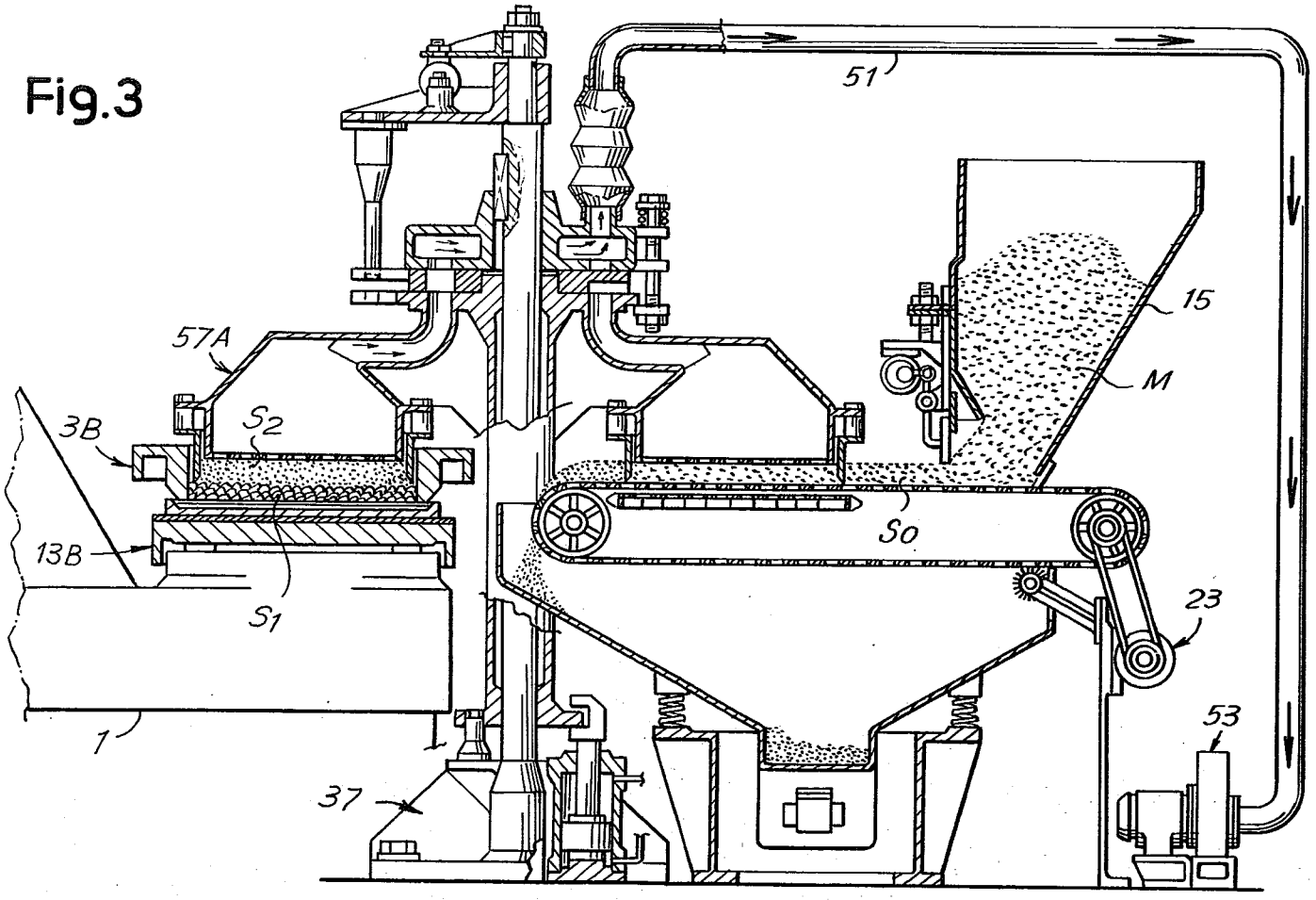
FIG. 3 is similar to FIG. 2, but shows a second phase of operation.
Figure 4:
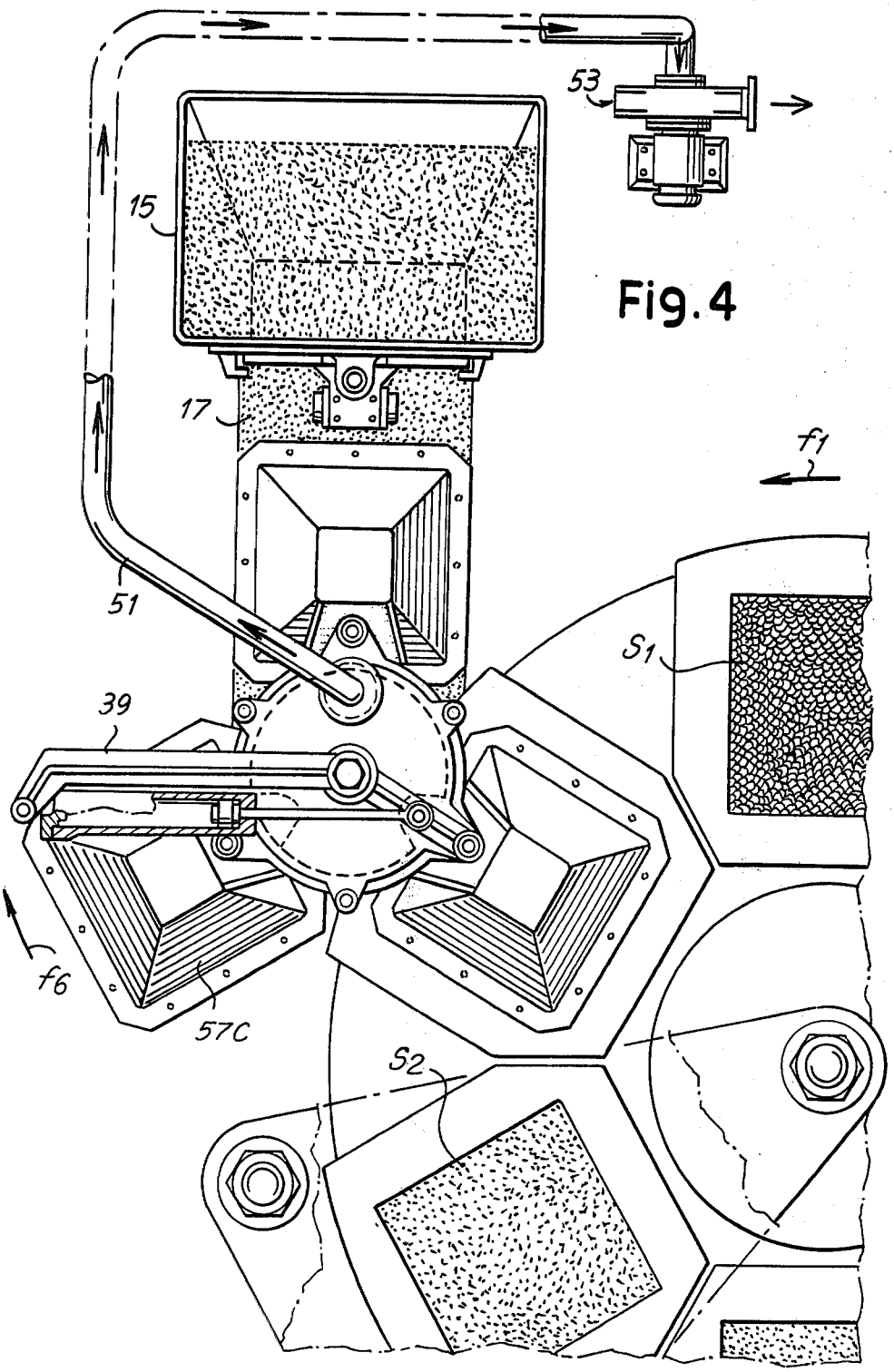
FIGS. 4 and 5 are similar to FIGS. 1 and 2 respectively, but show an array corresponding to a third phase of operation.
Figure 5:
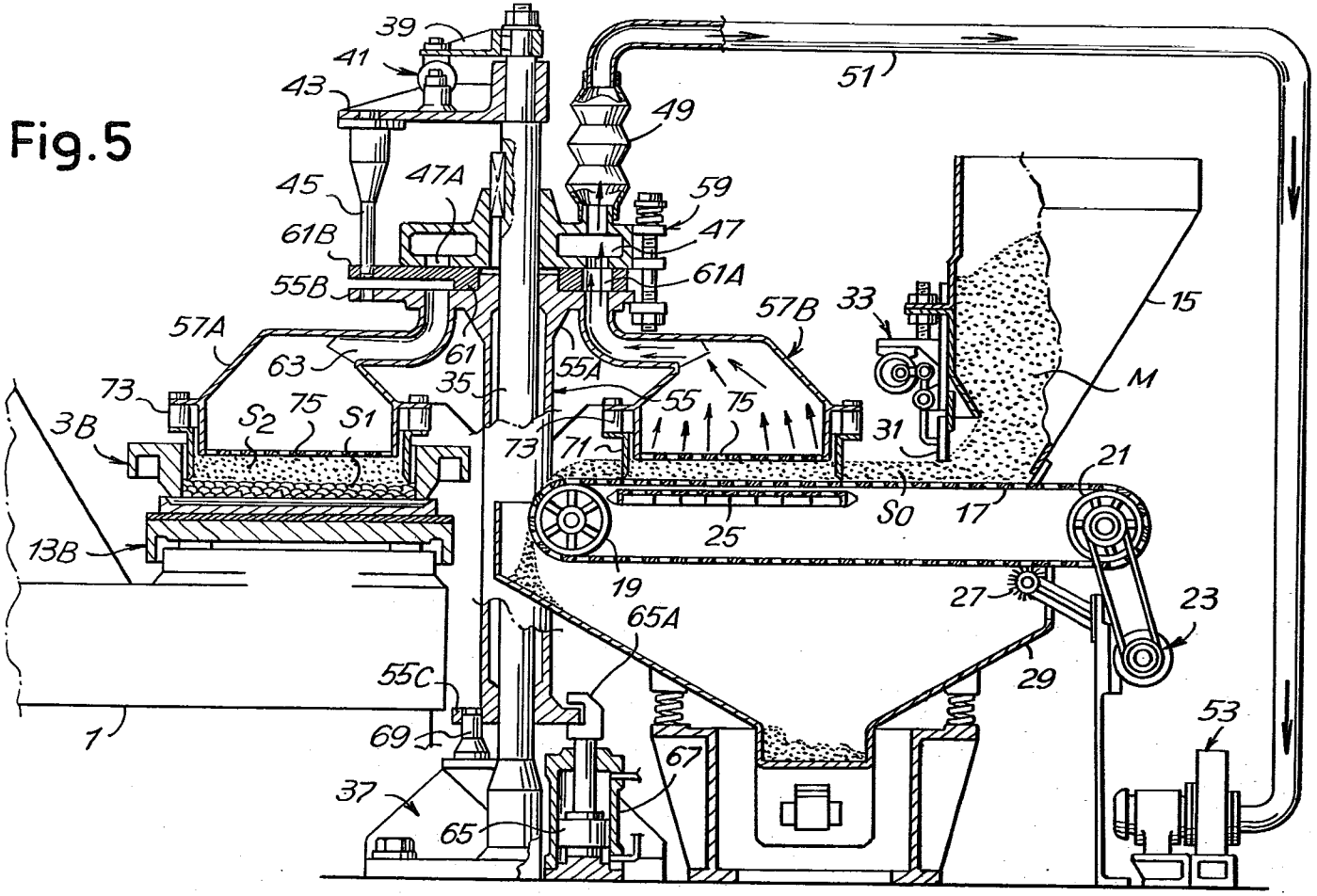

From this array of FIG. 3 in a third phase the array of FIGS. 4 and 5 is reached. In this array the bells maintain the position already reached in FIG. 3, but the distributor or shutter 61 was moved from the position of FIG. 1 to the position of FIG. 4 by virtue of the cylinder-piston system 41. In this way the communication between the bells in position 57B and the conduit 51 is obtained, thereby the material defined by the edge 71 of said bell sticks against the porous wall 75 by the effect of the air stream flowing across the conveyor belt 17 and the permeable support 25. Conversely, the bell in position 57A reaches atmospheric pressure because of the passage of air towards the interior of the bell from the recess 61C. If a layer of material S2 was kept, by suction, against the wall 75 by means of the suction effected by the bell 57A, this material of layer S2 now falls, or, more specifically is laid down upon the layer S1 of the mould in position 3B, within whose frame the edge 71 of the bell stay in position 57A.

Figure 6:
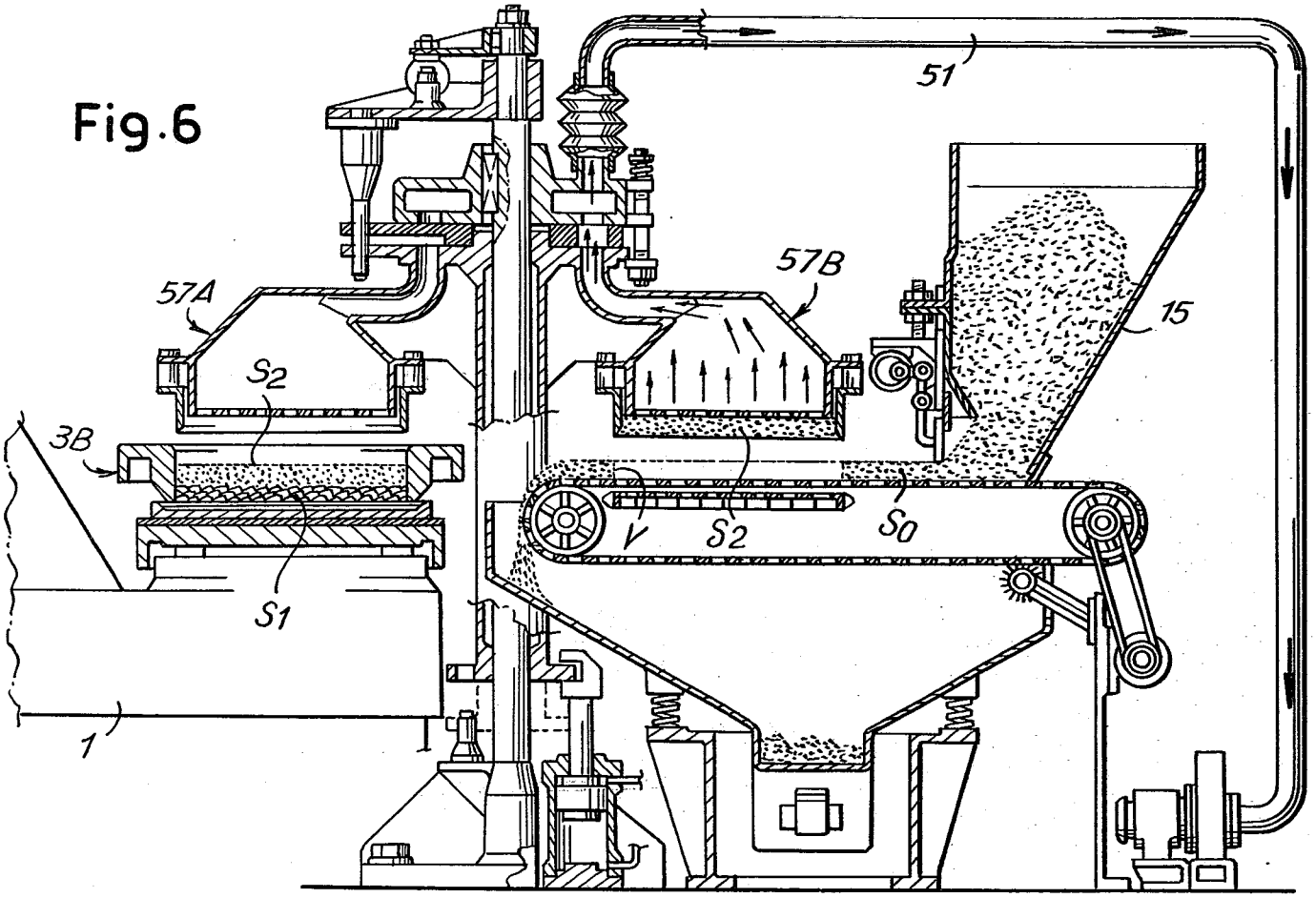
FIG. 6 is similar to FIGS. 2, 3 and 5 and shows an array corresponding to a fourth phase of operation.

In a forth phase (see FIG. 6) the cylinder-piston system 65, 67 raises the equipment 55, 55A and then the bells 57 to reach the position shown in FIG. 6. With respect to the condition shown in FIG. 5, there is a another layer S2 raised with the porous wall 75 of the bell in position 57B and the raising of the bell 57A without the layer S2, which remains laid down upon the layer S1 of the mould in position 3B.

In the above conditions an angular motion of the table 1 occurs of an angular length between two subsequent moulds, so that a mould that contains only the layer S1 reaches position 3B, while the mould with the layers S1 and S2 is moved to a subsequent pressing or vibration position. The equipment 55, 55A simultaneously shifts by 120° according to arrow f6 and by virtue of the control of the cylinder-piston system 41 which carries said equipment integral with the bells and the distributor 61, since the pin 45 for raising the equipment 55, 55A has engaged again, besides the appendix 61B, also the appendex 55B. As a consequence, the bell which was before in the position 57A shifts to the waiting or cleaning position 57C, since the same bell is without the material S2. The bell previously positioned at 57B moves with the new layer S2 to the position 57A above the new mould which reaches the position 3B, 13B. The bell previously located in the waiting position 57C reaches the position 57B. Thus, the starting conditions of a new cycle are reached again as shown in FIGS. 1 and 2.

Meanwhile the conveyor belt 17 was advanced so as to have the continuous layer SO again under the bell in the position 57B and to mask the empty region V, shown in FIG. 6, and due to the drawing of the layer S2 through the bell 57B, raised in the array of FIG. 6. The excess material which passed below the position 57B of the bells (to ensure a uniform layer SO for a new drawing step) falls into the collection hopper 29 and can be raised again within the supply hopper 15. Practically, in this fifth phase, the same conditions of FIGS. 1 and 2 are actually reached again, except the shift by 120° of the equipment 55, 55A of the bells 57 and the angular shift of the mould table equal to the distance between subsequent moulds.

From this position a new cycle to lay down the just raised layer S2 and to draw a new layer S2 is resumed.

It is evident that the described equipment permits reduced times and therefore the increase of the working rhythm with an acceleration of the production, while, however, excessive accelerations and speeds of the cyclic motion elements is not required.

While a specific embodiment of the invention has been shown and described in detail to illustrate the application of the principles of the invention, it will be understood that the invention may be embodied otherwise without departing from such principles.

What is claimed is:

1. A device for loading a dosage layer of material at a laying-down position to form a tile comprising, material layer supply means adapted for providing a layer of material in a drawing-up position, bell means having an air-permeable diaphragm and a surrounding edge defining a dosage space for receiving the dosage layer of material, drive means connected to said bell means for intermittently moving said bell means into the drawing-up position to receive a dosage layer of material in said dosage space and then into the laying-down position to release the dosage layer of material, and suction means connected to said bell means for establishing an under pressure in said bell means when said bell means is at the drawing-up position for holding the dosage layer in the dosage space and for establishing atmospheric pressure in said bell means when said bell means is in the laying-down position for releasing the dosage layer of material, said drive means comprising rotary drive means for rotating said bell means angularly from the vicinity of the drawing-up position to the vicinity of the laying-down position, vertical drive means for moving said bell means vertically down into the provided layer of material in the drawing-up position and down into the laying-down position and a column, said bell means comprises a turret carrying a plurality of bells each having a diaphragm and surrounding edge, said turret rotatably and slidably mounted on said column, said rotary drive means comprising a fixed arm connected to and extending radially outwardly of said column, a rotatable arm rotatably mounted to said column, an actuator connected between said fixed and rotatable arms for rotating said rotatable arm, and an engagement pin connected to said rotatable arm and movable by said vertical drive means to engage said turret and rotate said turret.

2. A device according to claim 1, wherein said vertical drive means comprise a flange extending radially outwardly of said turret, a molded member engaging said flange, and a vertical actuator connected to said molded member for moving said molded member vertically to move said turret vertically.

3. A device according to claim 1 including spacer means connected between said edge and diaphragm for adjusting the extension of said edge beyond said diaphragm.

4. A device according to claim 1, further including a collector slidably connected to said column and rotationally fixed therewith, a shutter member rotatably mounted on said column and between said turret and collector, said pin engaged with said shutter member to rotate said shutter member when said turret is raised and lowered, said pin disengaged from said turret when said turret is lowered and engaged only with said shutter.

5. A device according to claim 4, wherein said turret carries three of said bells, wherein, with one of said bells in the vicinity of the drawing-up position, another of said bells is in the vicinity of the laying-down position and the last of said bells is in a cleaning position, said bells being equally positioned around said turret.

6. A device for loading a dosage layer of material at a laying-down position to form a tile comprising, material layer supply means adapted for providing a layer of material in a drawing-up position, bell means having an air-permeable diaphragm and a surrounding edge defining a dosage space for receiving the dosage layer of material, drive means connected to said bell means for intermittently moving said bell means into the drawing-up position to receive a dosage layer of material in said dosage space and then into the laying-down position to release the dosage layer of material, and suction means connected to said bell means for establishing an underpressure in said bell means when said bell means is at the drawing-up position for holding the dosage layer in the dosage space and for establishing atmospheric pressure in said bell means when said bell means is in the laying-down position for releasing the dosage layer of material, said drive means comprising rotary drive means for rotating said bell means angularly from the vicinity of the drawing-up position to the vicinity of the laying-down position, vertical drive means for moving said bell means vertically down into the provided layer of material in the drawing-up position and down into the laying-down position said suction means comprising a shutter having at least one aperture therethrough, a column for rotatably and slidably supporting said bell means and for rotatably receiving said shutter, a suction pump connectable to an interior of said bell means, said shutter rotatable to establish communication between the interior of said bell means and said pump and for blocking such communication.

7. A device according to claim 6, wherein said bell means comprises a turret rotatably and slidably mounted on said column, a plurality of bells connected to said turret each having a diaphragm and surrounding edge, and a collector slidably mounted to said column but angularly fixed therewith and connected between said shutter and said suction pump for receiving air drawn out of an interior of one of said bells to establish the underpressure therein.

* * * * *